US010727622B2

(12) United States Patent
Matsunaga et al.

(10) Patent No.: US 10,727,622 B2
(45) Date of Patent: Jul. 28, 2020

(54) BOARD-MOUNTED CONNECTOR

(71) Applicant: Yazaki Corporation, Minato-ku, Tokyo (JP)

(72) Inventors: Takashi Matsunaga, Makinohara (JP); Shin Nemoto, Makinohara (JP); Kazuhito Kawabe, Makinohara (JP)

(73) Assignee: Yazaki Corporation, Minato-ku, Tokyo (JP)

( * ) Notice: Subject to any disclaimer, the term of this patent is extended or adjusted under 35 U.S.C. 154(b) by 0 days.

(21) Appl. No.: 16/534,477

(22) Filed: Aug. 7, 2019

(65) Prior Publication Data

US 2020/0052430 A1 Feb. 13, 2020

(30) Foreign Application Priority Data

Aug. 10, 2018 (JP) ..... 2018-151135

(51) Int. Cl.

| | |
|---|---|
| ***H01R 24/00*** | (2011.01) |
| ***H01R 13/41*** | (2006.01) |
| ***H01R 12/70*** | (2011.01) |
| ***H01R 12/57*** | (2011.01) |

(52) U.S. Cl.

CPC ..... *H01R 13/41* (2013.01); *H01R 12/57* (2013.01); *H01R 12/707* (2013.01)

(58) Field of Classification Search

CPC ..... H01R 12/57; H01R 12/707; H01R 13/41
USPC ..... 439/660
See application file for complete search history.

(56) References Cited

U.S. PATENT DOCUMENTS

| | | | | |
|---|---|---|---|---|
| 5,181,865 | A * | 1/1993 | Hayes, Sr. | H01R 13/4365 29/842 |
| 5,306,196 | A * | 4/1994 | Hashiguchi | H01R 13/516 439/607.01 |
| 5,482,470 | A * | 1/1996 | Atsumi | H01R 13/41 439/246 |
| 5,707,249 | A * | 1/1998 | Byrd | H01M 2/1055 361/767 |
| 6,227,901 | B1 * | 5/2001 | Pupkiewicz | G08B 6/00 439/500 |
| 6,358,062 | B1 * | 3/2002 | Feldman | H01R 23/688 439/63 |
| 7,192,313 | B2 * | 3/2007 | Sai | H01R 13/53 439/660 |

(Continued)

FOREIGN PATENT DOCUMENTS

JP 2008-135314 A 6/2008

*Primary Examiner* — Abdullah A Riyami
*Assistant Examiner* — Vladimir Imas
(74) *Attorney, Agent, or Firm* — Banner & Witcoff, Ltd.

(57) ABSTRACT

A board-mounted connector (1) includes plural terminals (10) and a housing (40) holding the terminals. The housing has, on its wall surface (40*a*), a pair of first holding portions (41) each covered with an inner surface of each of a pair of hood portions (41*a*), and a second holding portion (42) located more distant from a circuit board (2) than the first holding portions. The terminals include a pair of first terminals (20) held by the first holding portions, and a second terminal (30) held by the second holding portion. The second terminal has an intermediate portion (33) between a holding target portion (32) held by the second holding portion and a contact portion (34) to be connected to the circuit board. The intermediate portion is press-fitted in a gap (S) between respective outer surfaces (44) of the hood portions.

2 Claims, 3 Drawing Sheets

(56) References Cited

U.S. PATENT DOCUMENTS

| | | | | |
|---|---|---|---|---|
| 7,572,135 | B2 * | 8/2009 | Kozono | H01R 13/6315 439/248 |
| 7,794,288 | B2 * | 9/2010 | Shindo | H01R 13/533 439/347 |
| 8,206,178 | B2 * | 6/2012 | Hinteresch | H05K 7/12 439/620.24 |
| 8,553,429 | B2 * | 10/2013 | McNamara | H05K 3/301 361/801 |
| 8,573,988 | B2 * | 11/2013 | Fujikawa | H01R 12/722 439/79 |
| 8,627,564 | B2 * | 1/2014 | Blossfeld | H01R 12/00 29/883 |
| 9,106,017 | B2 * | 8/2015 | Kutsuna | H01R 13/4226 |
| 9,118,127 | B2 * | 8/2015 | Matsunaga | H01R 13/10 |
| 9,118,137 | B2 * | 8/2015 | Suzuki | H01R 13/42 |
| 9,281,609 | B2 * | 3/2016 | Suzuki | H01R 13/5202 |
| 9,425,549 | B2 * | 8/2016 | Sekino | H01R 13/6272 |
| 9,431,750 | B2 * | 8/2016 | Matsunaga | H01R 13/4538 |
| 9,596,763 | B2 * | 3/2017 | Nakamura | H05K 3/301 |
| 9,876,303 | B2 * | 1/2018 | Suemitsu | H01R 13/41 |
| 10,166,869 | B1 * | 1/2019 | Ohyama | H05K 7/1432 |
| 10,326,246 | B2 * | 6/2019 | Chang | H01R 12/707 |

* cited by examiner

BOARD-MOUNTED CONNECTOR

CROSS-REFERENCES TO RELATED APPLICATION(S)

This application is based on and claims priority from Japanese Patent Application No. 2018-151135 filed on Aug. 10, 2018, and the entire contents of which are incorporated herein by reference.

BACKGROUND

Field of the Invention

The present invention relates to a board-mounted connector.

Description of Related Art

Board-mounted connectors are known in which terminals to be connected to a circuit board by, for example, soldering are held by a housing. For example, in one conventional board-mounted connector, plural through-holes are formed through a wall of a housing and plural rod-like terminals are press-fitted in the respective through-holes and thereby held by the housing.

As for details of the above connector, refer to JP 2008-135314 A.

SUMMARY

In the above-described board-mounted connector, the distances between the plural through-holes and a circuit board may vary from one through-hole to another. In this case, where reflow soldering is performed to connect the plural terminals to the circuit board after they are press-fitted into the respective through-holes, usually the whole of the board-mounted connector is set in a high-temperature environment in a reflow furnace. At this time, a resin housing is expanded thermally. More specifically, the resin material of the housing is deformed so as to expand in such a direction as to be separated from the circuit board with its portion fixed to the circuit board as an origin. In general, the displacement of a through-hole that is distant from the circuit board is larger than that of a through-hole that is close to the circuit board though this tendency depends on the structure of the housing. This may result in a case that a terminal that is press-fitted in a through-hole that is distant from the circuit board is displaced by a long distance in such a direction as to be separated (i.e., lifted up) from the circuit board. From the viewpoint of increasing the reliability of the electrical connection between the terminals and the circuit board, it is desirable that such a displacement of a terminal be suppressed.

An object of the invention is to provide a board-mounted connector that is to be subjected to reflow soldering and can increase the reliability of the electrical connection between terminals and a circuit board irrespective of the position where each terminal is held by a housing.

Embodiments of the present invention provide the following items [1] and [2]:

[1] A board-mounted connector comprising:

a plurality of terminals to be electrically connected to a circuit board; and a housing made from resin and holding the plurality of the terminals, the housing having, on a wall surface of the housing, a pair of first holding portions each covered with an inner surface of each of a pair of hood portions extended from the wall surface, and a second holding portion being more distant from the circuit board than the pair of the first holding portions, the plurality of the terminals having a pair of first terminals held by the pair of the first holding portions, and a second terminal held by the second holding portion, the second terminal having an intermediate portion between a holding target portion held by the second holding portion and a contact portion to be connected to the circuit board, the intermediate portion being press-fitted in a gap between respective outer surfaces of the pair of the hood portions to cause the second terminal to be held by the pair of the hood portions.

[2] The board-mounted connector according to the item [1], wherein the pair of the hood portions each has a rib protruding toward the second terminal on the outer surface defining the gap to press-fit the second terminal.

According to first aspect of the invention, relating to the item [1], the second terminal held by the second holding portion which is more distant from the circuit board than the first holding portions are is also held being press-fitted in the gap between the pair of first holding portions. Thus, when the housing is expanded thermally in a high-temperature environment in a reflow furnace during soldering, the holding target portion of the second terminal is forced to be displaced to a relatively large extent together with the second holding portion. However, being sandwiched between the hood portions which are displaced less than the second holding portion, the intermediate portion of the second terminal is less prone to be displaced. As a result, the contact portion of the second terminal is less prone to be separated from the circuit board than in a case that the intermediate portion of the second terminal is not held by the hood portions. Usually, the difference between the displacements of the holding target portion and the intermediate portion of the second terminal can be absorbed by, for example, deformation of a portion between the holding target portion and the intermediate portion (i.e., second terminal itself).

As a result, in the board-mounted connector having the above configuration, that is, in the board-mounted connector to be subjected to reflow soldering, the reliability of the electrical connection between the terminal and the circuit board can be increased irrespective of the position where the terminal is held by the housing.

According to second aspect of the invention, relating to the item [2], the intermediate portion of the second terminal is pushed by the ribs which are provided on the pair of hood portions. Thus, stronger stress can be produced at the contact positions of the tops of the ribs and the intermediate portion of the second terminal than in a case that the intermediate portion of the second terminal is sandwiched between mere planes, whereby the second terminal 30 can be held strongly by the pair of hood portions. As a result, the reliability of the electrical connection between the second terminal and the circuit board can be increased further.

The invention can provide a board-mounted connector that is to be subjected to reflow soldering and can increase the reliability of the electrical connection between terminals and a circuit board irrespective of the position where each terminal is held by a housing.

The invention has been described above concisely. The details of the invention will become more apparent when the modes for carrying out the invention (hereinafter referred to as an embodiment) described below are read through with reference to the accompanying drawings.

DETAILED DESCRIPTION

Embodiment

Figure 1:
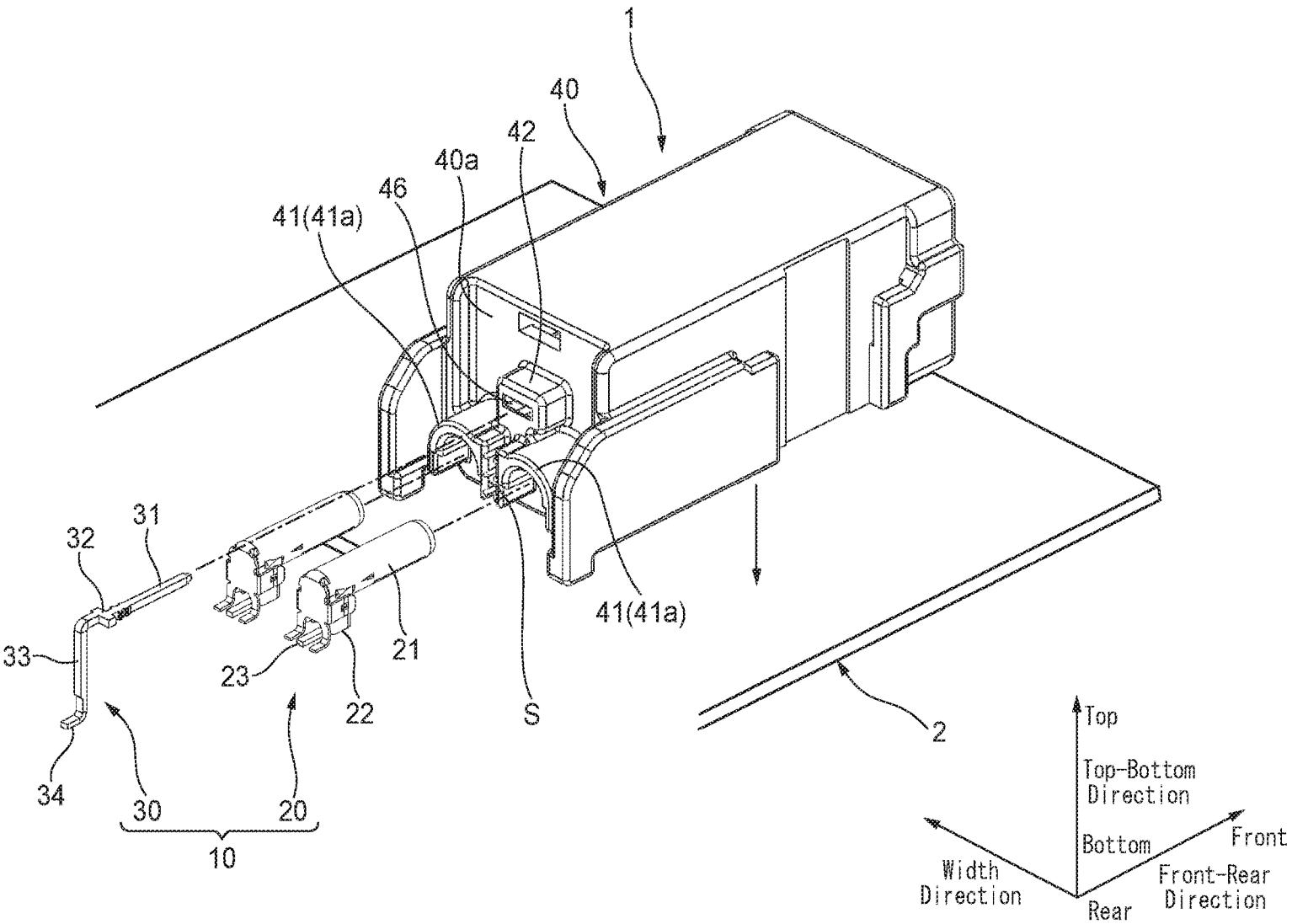
FIG. 1 is an exploded perspective view of a board-mounted connector according to an embodiment.

A board-mounted connector according to an embodiment of the present invention will be hereinafter described with reference to the drawings. As shown in FIG. 1, the board-mounted connector 1 according to the embodiment (hereinafter referred to simply as a "connector") is a connector to be mounted on the surface of a circuit board 2 and may be called a surface mount connector. The connector 1 is equipped with plural terminals 10 to be electrically connected to the circuit board 2 and a resin housing 40 that holds the plural terminals 10.

In the following, for convenience of description, the front-rear direction, the top-bottom direction, the width direction, the front side, the rear side, the top side, and the bottom side are defined as shown in FIG. 1. The front-rear direction, the top-bottom direction, the width direction are perpendicular to each other. The front-rear direction coincides with a fitting direction of the housing 40 and a counterpart housing. The front side in the fitting direction (i.e., the side of a counterpart connector) is the front side, and the fitting cancellation side in the fitting direction (i.e., the side opposite to the counterpart connector) is the rear side. The front-rear direction also coincides with a direction in which the terminals 10 are inserted into the housing 40 of the terminal 10.

First, the structures of the terminals 10 will be described. As shown in FIG. 1, in the embodiment, a pair of first terminals 20 and one second terminal 30 are used as metal terminals 10. Each first terminal 20 is equipped with a tubular press-fit portion 21 which extends in the front-rear direction, a hanging portion 22 which hangs down from a rear end portion of the press-fit portion 21, and a rod-like contact portion 23 which extends rearward from a bottom end portion of the hanging portion 22. The second terminal 30 is equipped with a rod-like connection portion 31 which extends in the front-rear direction, a wide press-fit portion 32 which is connected to a rear end portion of the connection portion 31, a rod-like intermediate portion 33 which hangs down from the rear end of the press-fit portion 32, and a rod-like contact portion 34 which extends rearward from a bottom end portion of the intermediate portion 33.

Next, the structure of the housing 40 will be described. As shown in FIG. 1, the resin housing 40 is generally a cuboid box-shaped body that is open on the front side and closed on the rear side by a rear end wall 40*a* and has an internal space. The counterpart housing (not shown) is to be inserted and fitted into the housing 40 through its front opening.

The rear end wall 40*a*, shaped like a flat plate, of the housing 40 is formed with, in a lower region, a pair of first holding portions 41 for holding the pair of first terminals 20 in such a manner that the first holding portions 41 are arranged at intervals in the width direction. The rear end wall 40*a* is also formed with, above the middle between the pair of first holding portions 41, one second holding portion 42 for holding the one second terminal 30.

Figure 2A:
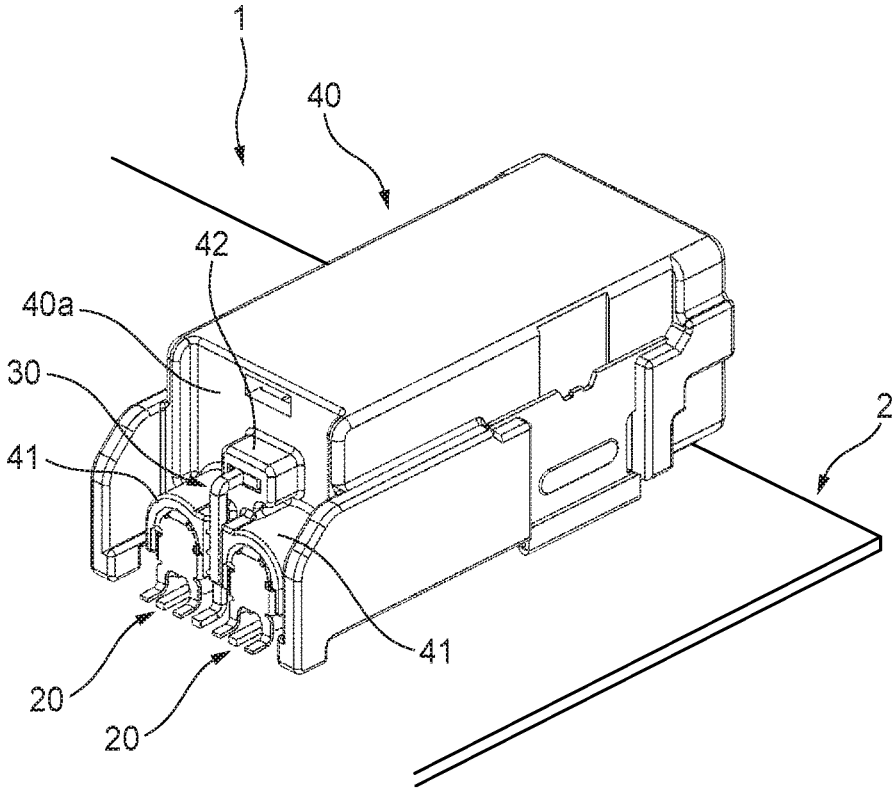
FIG. 2A is a perspective view of the board-mounted connector that is mounted on a circuit board.
Figure 2B:
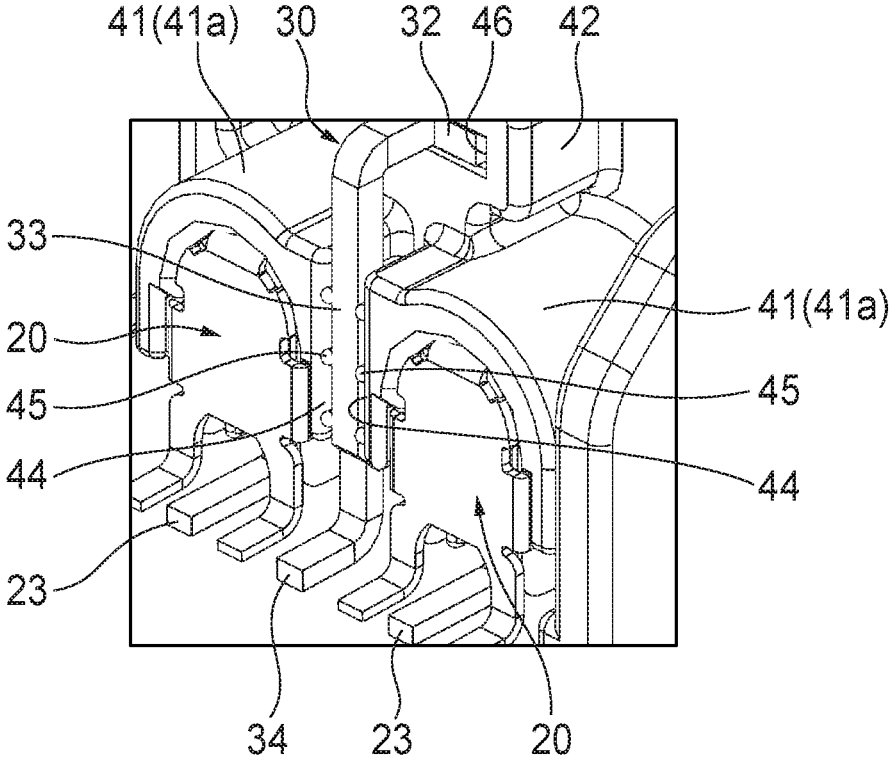
FIG. 2B is an enlarged view of part of FIG. 2A and shows a pair of first holding portions and a second holding portion and their neighborhood.

Each first holding portion 41 is composed of a hood portion 41 a which projects rearward from the rear end wall 40*a* and is open at the bottom (i.e., on the side where it faces the circuit board 2) and is thus shaped like a hood and a portion, covered with the inner surface of the hood potion 41*a*, of the rear end wall 40*a*. Each first holding portion 41 is formed with a through-hole 43 (see FIG. 3A) which penetrates through the rear end wall 40*a* in the front-rear direction. As shown in FIGS. 2A and 2B, each first terminal 20 is held by the corresponding first holding portion 41 when the press-fit portion 21 of the first terminal 20 is press-fitted into the through-hole 43.

As shown in FIG. 2B, an outer side surface 44, located inside in the width direction, of the hood portion 41*a* of each first holding portion 41 is a flat surface that extends in both of the top-bottom direction and the front-rear direction. As a result, a gap S (see FIG. 1) which extends in the top-bottom direction is formed between the pair of outer side surfaces 44 which are opposed to each other in the width direction. Each outer side surface 44 is formed with, at plural (in the embodiment three) positions in the top-bottom direction, ribs 45 which project inward in the width direction.

The second holding portion 42 is composed of a solid cuboid-shaped portion which projects rearward and from the rear end wall 40*a* and a portion, facing the cuboid-shaped portion, of the rear end wall 40*a*. The rearward projection length, from the rear end wall 40*a*, of the cuboid-shaped portion is shorter than that of the hood portion 41 a of each first holding portion 41. The second holding portion 42 is formed with a through-hole 46 (see FIG. 1) which penetrates through both of the rear end wall 40*a* and the cuboid-shaped portion in the front-rear direction. As shown in FIGS. 2A and 2B, the second terminal 30 is held by the second holding portion 42 when the press-fit portion 32 of the second terminal 30 is press-fitted in the through-hole 46.

As shown in FIG. 2B, in a state that the second terminal 30 is held by the second holding portion 42, the intermediate portion 33, extending in the top-bottom direction, of the second terminal 30 is located in the gap S formed between the pair of first holding portions 41. Since the intermediate portion 33 is a little wider than the interval between the tops of ribs 45 that are opposed to each other in the width direction, the intermediate portion 33 of the second terminal 30 is press-fitted between the pair of first holding portions 41 (i.e., set in the gap S) and held by the pair of first holding portions 41.

Figure 3A:
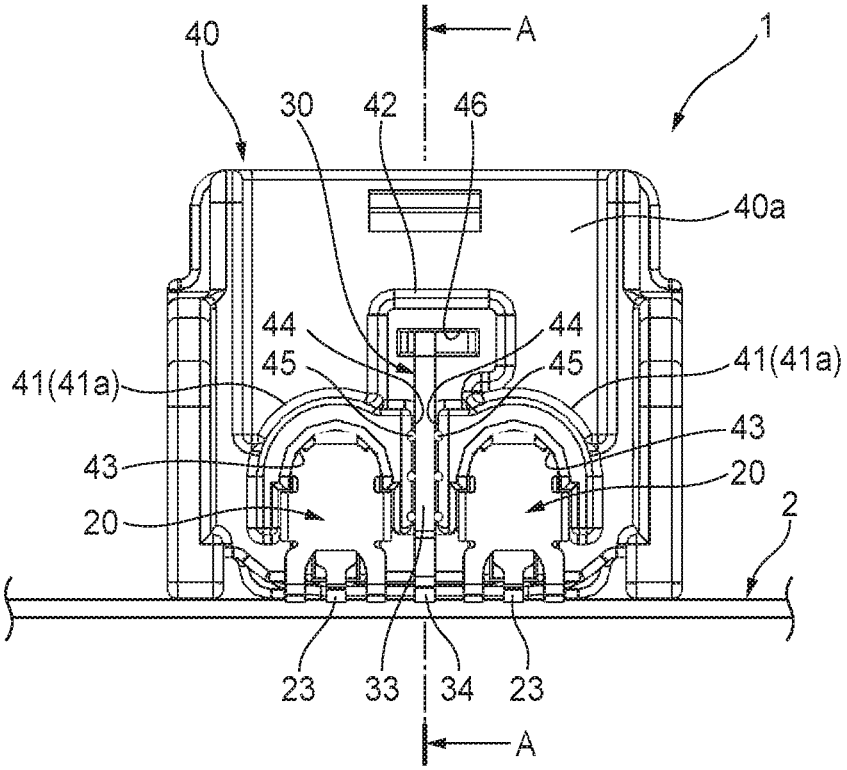
FIG. 3A is a front view of the board-mounted connector that is mounted on the circuit board.

As shown in FIGS. 2A and 2B and FIG. 3A, in a state that the pair of first terminals 20 are held by the pair of first holding portions 41 and the second terminal 30 is held by the second holding portion 42, the bottom surfaces of the contact portions 23 of the pair of first terminals 20 and the bottom surface of contact portion 34 of the second terminal 30 are located in a single plane (i.e., they are coplanar).

As shown in FIGS. 2A and 2B and FIG. 3A, the housing 40 being in a state that it holds the pair of first terminals 20 and the second terminal 30 is mounted on the circuit board 2 by fixing a prescribed portion (fixing portion) provided on the bottom wall of the housing 40 to the circuit board 2. Then the contact portions 23 of the pair of first terminals 20 and the contact portion 34 of the second terminal 30 are soldered to the circuit board 2 by a reflow method. As a result, the board-mounted connector 1 is completed which is mounted on the circuit board 2.

In the following, advantages of the board-mounted connector 1 according to the embodiment of the invention that are obtained as a result of the fact that the intermediate portion 33 of the second terminal 30 is press-fitted in the gap S between the pair of first holding portions 41 and held being pushed by the pair of first holding portions 41 will be described together with its workings.

When the contact portions 23 of the pair of first terminals 20 and the contact portion 34 of the second terminal 30 are soldered to the circuit board 2 by the reflow method, the board-mounted connector 1 itself is set in a high-temperature environment in a reflow furnace. At this time, the resin housing 40 is expanded thermally. During this thermal expansion, the resin material of the housing 40 is deformed so as to expand in such a direction as to be separated from the circuit board 2 with its portion fixed to the circuit board 2 as an origin. In general, the displacement of second holding portion 42 which is distant from the circuit board 2 is larger than that of the pair of first holding portions 41 which are close to the circuit board 2 though this tendency depends on the structure of the housing 40.

Figure 3B:
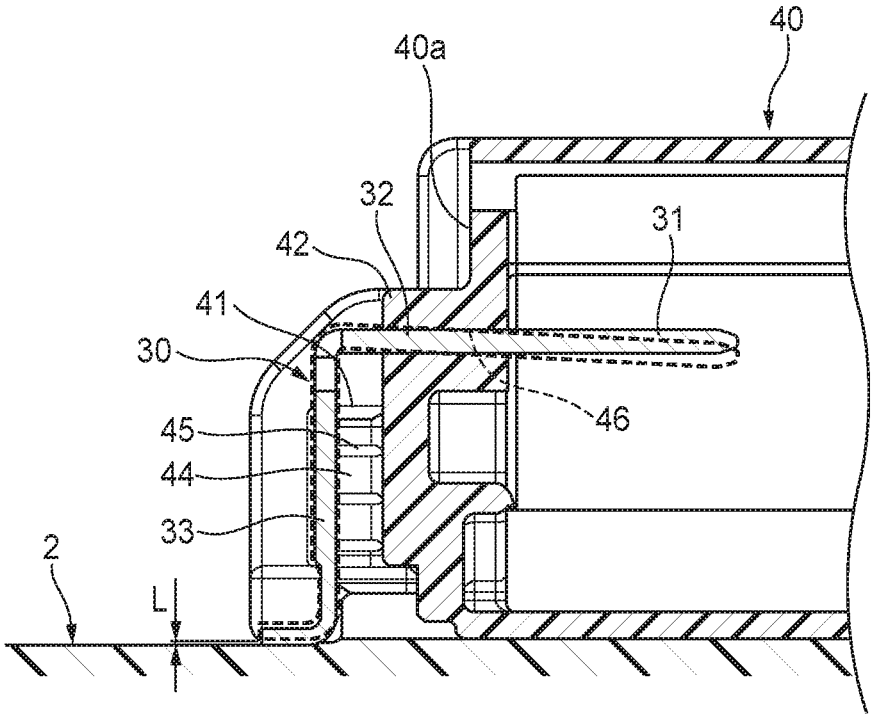
FIG. 3B is an A-A sectional view of FIG. 3A.

This may result in a case that the second terminal 30 which is held by the second holding portion 42 which is at the position that is distant from the circuit board 2 is displaced by a longer distance in such a direction as to be separated (i.e., lifted up) from the circuit board 2 (in particular, upward; refer to a displacement L shown in FIG. 3B) than the first terminals 20 which are held by the first holding portions 41 which are at the positions that are close to the circuit board 2. This may result in reduction of the flatness (coplanarity) of the plane formed by the contact portions 23 of the pair of first terminals 20 and the contact portion 34 of the second terminal 30; in particular, the reliability of the electrical connection between the second terminal 30 and the circuit board 2 may be lowered.

In contrast, in the board-mounted connector 1 according to the embodiment of the invention, since the intermediate portion 33 of the second terminal 30 is press-fitted in the gap S between the pair of first holding portions 41 and held being pushed by the pair of first holding portions 41, the intermediate portion 33 of the second terminal 30 is not prone to be displaced being sandwiched between the pair of first holding portions 41. Thus, the displacement L of the intermediate portion 33 of the second terminal 30 from the circuit board 2 is smaller and less prone to be separated from the circuit board 2 than in a case that it is not held in this manner. As a result, in the board-mounted connector 1 to be connected to the circuit board 2 by reflow soldering, the reliability of the electrical connection between the terminal 10 and the circuit board 2 can be increased irrespective of the position where the terminal 10 is held by the housing 40.

Furthermore, the intermediate portion 33 of the second terminal 30 is held by the pair of first holding portions 41 in such a manner as to be pushed by the ribs 45 which are provided on the pair of first holding portions 41. Thus, stronger stress can be produced at the contact positions of the tops of the ribs 45 and the intermediate portion 33 of the second terminal 30 than in a case that the intermediate portion 33 of the second terminal 30 is sandwiched between mere planes, whereby the second terminal 30 can be held strongly by the pair of first holding portions 41. As a result, the reliability of the electrical connection between the second terminal 30 and the circuit board 2 can be increased further.

Other Embodiments

In addition, the invention is not limited to the aforementioned embodiments, but various modifications can be used within the scope of the invention. For example, the invention is not limited to the aforementioned embodiments, but changes, improvements, etc. can be made on the invention suitably. In addition, materials, shapes, dimensions, numbers, arrangement places, etc. of respective constituent elements in the aforementioned embodiments are not limited. Any materials, any shapes, any dimensions, any numbers, any arrangement places, etc. may be used as long as the invention can be attained.

In the above embodiment, the two (pair of) first holding portions 41 for holding the two (pair of) first terminals 20 and the one second holding portion 42 for holding the one second terminal 30 are provided. Alternatively, two or more first holding portions 41 for holding two or more first terminals 20 and the one or more second holding portions 42 for holding one or more second terminals 30 may be provided as long as there exists a portion where the intermediate portion 33 of each second terminal 30 held by a second holding portion 42 is press-fitted in the space S between adjacent first holding portions 41.

Features of the board-mounted connector 1 according to the embodiment of the invention will be summarized below concisely in the form of items [1] and [2]:

[1] A board-mounted connector (1) comprising:

a plurality of terminals (10) to be electrically connected to a circuit board (2); and a housing (40) made from resin and holding the plurality of the terminals (10), the housing (40) having, on a wall surface (40*a*) of the housing (40), a pair of first holding portions (41) each covered with an inner surface of each of a pair of hood portions (41*a*) extended from the wall surface (40*a*), and a second holding portion (42) being more distant from the circuit board (2) than the pair of the first holding portions (41), the plurality of the terminals (10) having a pair of first terminals (20) held by the pair of the first holding portions (41), and a second terminal (30) held by the second holding portion (42), the second terminal (30) having an intermediate portion (33) between a holding target portion (32) held by the second holding portion (42) and a contact portion (34) to be connected to the circuit board (2), the intermediate portion (33) being press-fitted in a gap (S) between respective outer surfaces (44) of the pair of the hood portions (41*a*) to cause the second terminal (30) to be held by the pair of the hood portions (41*a*).

[2] The board-mounted connector (1) according to the item [1], wherein the pair of the hood portions (41*a*) each has a rib (45) protruding toward the second terminal (30) on the outer surface defining the gap (S) to press-fit the second terminal (30).

REFERENCE SIGNS LIST

1: Connector (board-mounted connector)
2: Circuit board
10: Terminal
20: First terminal

30: Second terminal
32: Press-fit portion (holding target portion)
33: Intermediate portion
34: Contact portion
40: Housing
41: First holding portion
41*a:* Hood portion
42: Second holding portion
44: Outer side surface
45: Rib
S: Gap

The invention claimed is:

1. A board-mounted connector comprising:

a plurality of terminals to be electrically connected to a circuit board; and a housing made from resin and holding the plurality of the terminals, the housing having, on a wall surface, a pair of first holding portions each covered with an inner surface of each of a pair of hood portions extending from the wall surface, and a second holding portion being more distant from the circuit board than the pair of first holding portions, the plurality of the terminals having a pair of first terminals held by the pair of first holding portions, and a second terminal held by the second holding portion, the second terminal having an intermediate portion between a holding target portion held by the second holding portion and a contact portion to be connected to the circuit board, the intermediate portion being press-fitted in a gap between respective outer surfaces of the pair of hood portions to cause the second terminal to be held by the pair of hood portions.

2. The board-mounted connector according to claim 1, wherein each of the pair of hood portions has a rib protruding toward the second terminal on the outer surface defining the gap to press-fit the second terminal.

* * * * *